United States Patent [19]
Simpson et al.
[11] 4,307,861
[45] Dec. 29, 1981

[54] BAG SUPPORT MEANS

[75] Inventors: Ralph E. Simpson, Upland; Michael L. Simpson, Ontario, both of Calif.

[73] Assignee: Simpson Enterprises, Upland, Calif.

[21] Appl. No.: 162,572

[22] Filed: Jun. 24, 1980

Related U.S. Application Data

[63] Continuation of Ser. No. 18,343, Mar. 7, 1979, abandoned.

[51] Int. Cl.[3] ..... A63B 55/04
[52] U.S. Cl. ..... 248/97; 248/165
[58] Field of Search ..... 248/97, 99, 100, 101, 248/165; 150/49

[56] References Cited

U.S. PATENT DOCUMENTS

| | | | |
|---|---|---|---|
| 1,356,142 | 10/1920 | Harris | 248/97 |
| 1,694,079 | 12/1928 | Nicholas | 248/97 |
| 1,971,642 | 8/1934 | Champlin | 248/97 |
| 2,022,291 | 11/1935 | Lehman | 248/165 |
| 2,470,977 | 5/1949 | Chidsey | 248/97 |
| 2,503,118 | 4/1950 | Mannix | 248/100 |
| 2,754,076 | 7/1956 | Westervelt | 248/100 X |
| 2,914,281 | 11/1959 | Johnson | 248/165 UX |
| 3,352,520 | 11/1967 | Bumgarner et al. | 248/97 X |
| 3,633,859 | 1/1972 | Vosbikian | 248/165 X |
| 3,771,752 | 11/1973 | Meeh | 248/99 X |

FOREIGN PATENT DOCUMENTS

| | | | |
|---|---|---|---|
| 455847 | 10/1936 | United Kingdom | 248/101 |

*Primary Examiner*—J. Franklin Foss
*Attorney, Agent, or Firm*—John H. Crowe

[57] ABSTRACT

A lightweight, collapsible frame for holding a plastic trash bag upright to receive trash. The frame includes a triangular base formed from three pivoted strips that can be folded together for storage when not in use. Additionally, the frame includes three tubular posts or props which are removably attachable to the corners of the triangular base in such a way as to stand upright around the space above the base. Each of the tubular posts has a crosspiece fitted to its upper end for pivotal movement between a first position crosswise of the post, where it serves to prop up the wall of a trash bag in the space above the base when the top of the bag is folded down over it, and a second position at right angles to the first for easy packing and storage purposes. A spring clip is fastened to each of the tubular posts near its upper end. A trash bag is attached to the frame for use by placing it in the space separating the upright posts above the base, with its bottom end down; folding its top edge outwardly over the crosspieces on the posts (after each has been placed in the crosswise position mentioned above) far enough to reach the spring clips on the posts; and securing the edge of the bag in the spring clips. The bag is now ready to receive trash.

8 Claims, 11 Drawing Figures

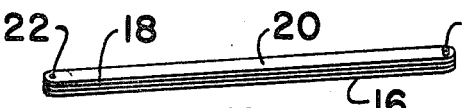
FIG.2.
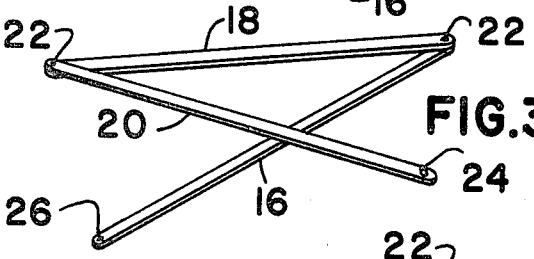
FIG.3.
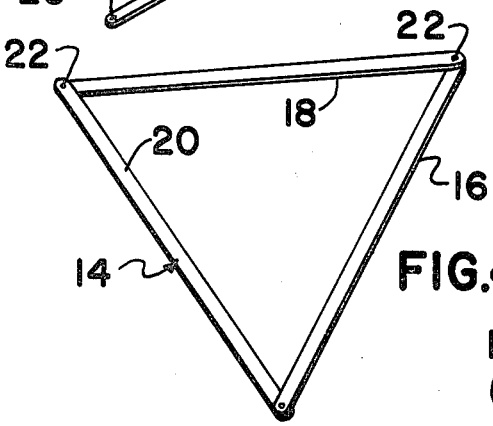
FIG.4.
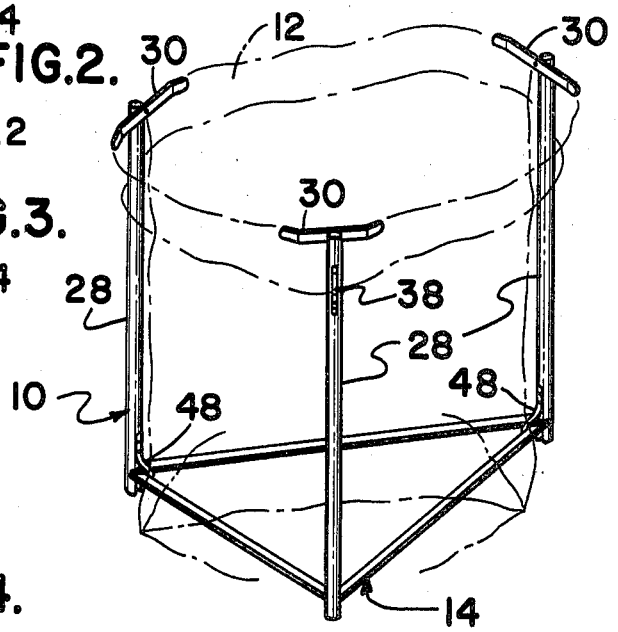
FIG.1.
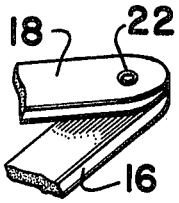
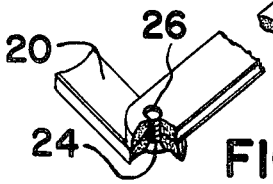
FIG.5.
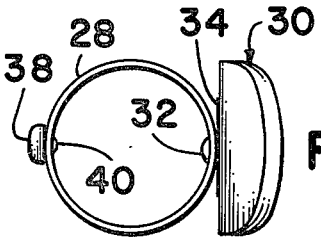
FIG.9.
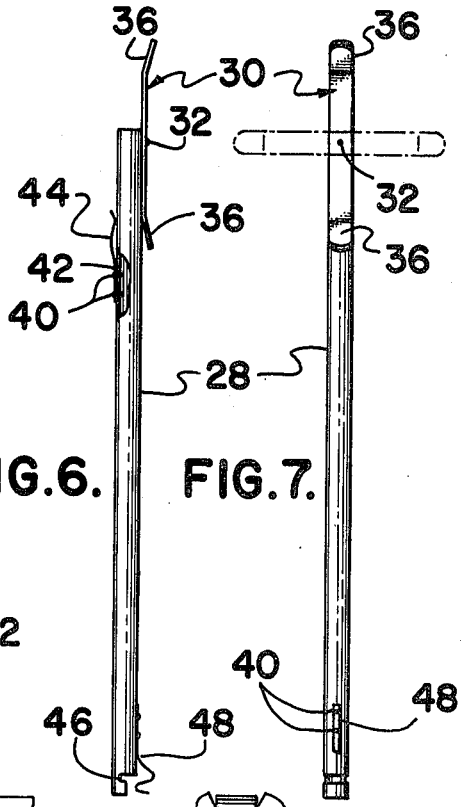
FIG.6. FIG.7.
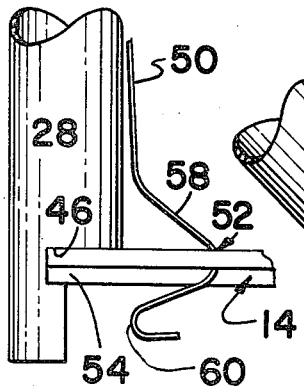
FIG.11.
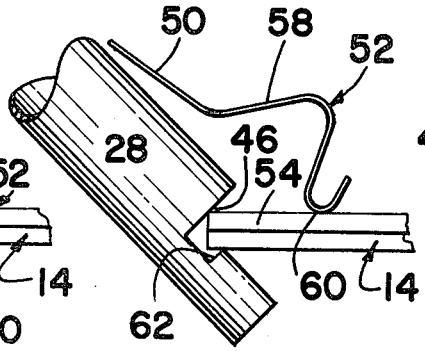
FIG.10.
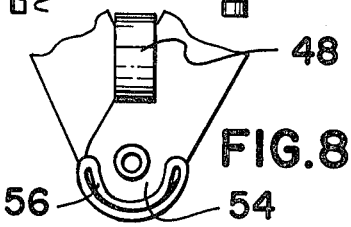
FIG.8.

BAG SUPPORT MEANS

This is a continuation, of application Ser. No. 018,343, filed Mar. 7, 1979, now abandoned.

BACKGROUND OF THE INVENTION

This invention relates generally to means for holding an open bag upright, and more particularly to such means for support of a plastic trash bag for trash receiving purposes.

Thin-walled plastic trash bags have come into widespread usage in recent years for the collection and disposal of trash and rubbish such as household garbage, wastepaper, raked leaves, grass clippings, and the like. Such bags are available at low cost as throw-away trash containers that can be loaded with discard material, then tied at the top for easy pickup by rubbish collectors or other disposal. These bags have served their purpose well, but their usage has heretofore presented certain problems. Because of their thin-walled nature, the bags cannot stand alone, and must be held open in some way while they are being filled with trash. This can be done manually, but with difficulty, and it usually requires the presence of two persons, one to hold the bag open while the other fills it with trash. Such a procedure can result in waste of bag space because of the difficulty of holding the bag open in a way to most effectively load it.

Another technique for loading plastic trash bags involves the use of a garbage or rubbish can, in which case the bag is opened inside the can and its upper end folded down around the can rim. After the bag is filled, it is pulled from the can and tied up for disposal. There are several disadvantages to this procedure, among which are the difficulty of removing the filled bag from the can, a tendency of the bag to slip down into the can after a certain amount of trash has been placed in it and incomplete loading of the bag because its shape does not conform to the can interior well enough to permit full-capacity loading thereof. Also, air trapped between the bag and can walls generally causes the bag to balloon inwardly when it is being loaded, thus increasing the difficulty of filling the bag to its true capacity with trash.

While we are aware of a bag-holding device having a pair of parallel rails over which the opposite sides of the top of a bag can be folded for support, this device is not entirely satisfactory because of a tendency of the bag wall to slide off of the rails as the bag is being loaded and an inherent inability of the device to spread the mouth of the bag in a way to insure most effective loading thereof.

Plastic trash bags are ideally suited for trash disposal use in recreational vehicles, such as campers and the like, on board boats, in camping areas, and in other places where living and storage space is at a premium. The above-noted disadvantages of bag loading techniques, however, carry over into the use of such bags here. Moreover, the bulky nature of garbage or trash cans makes their use as trash bag holders even less attractive in crowded camper, boat, and similar environments than in ordinary household environments, with adequate storage space for such cans.

In view of the foregoing, it is apparent that a clear need exists for some sort of means to support a plastic trash bag in open position for the receipt of trash as the bag is being filled, while permitting full-capacity loading of the bag and easy handling thereof for closure and disposal once it is filled.

SUMMARY OF THE INVENTION

We have now, by this invention, provided an inexpensive, lightweight, collapsible frame for holding a plastic bag upright for the receipt of trash in such fashion that the bag can be filled to substantially its full capacity and then easily lifted away from the frame for disposal. The frame is provided with means for supporting the bag in upright position until it is filled to the desired extent, and is designed to hold the mouth of the bag open wide enough to permit easy loading thereof by a single individual. Moreover, the frame does not restrict expansion of the bag as it is being loaded, cause inward ballooning thereof at any time or confine the loaded bag in a way to prevent its easy removal therefrom, as does a can or drum in which such a bag is being loaded. Consequently, our novel bag support frame permits the use of plastic trash bags with maximum ease and effectiveness, and without any of the above-mentioned disadvantages of presently employed bagging practices.

In addition to its above-noted advantages over prior art bag holding means, the novel bag holding frame of this invention can be collapsed to compact form for convenient transport or storage, and when set up for use it occupies minimal space and has a trim, functional appearance, unlike the plain, bulky appearance of the usual trash container. It is thus ideally suited for service in recreational vehicles, boats, etc., where space conservation is important, or by campers or others with limited room for packing and carrying their gear and equipment.

Our unique bag support frame comprises a folding base having jointed sections adjustable between a compact folded position and an open position in which the sections form a triangle. In its preferred form, the bag support frame has three tubular posts or props provided with spring clips at one end designed to permit the posts to be removably fastened to the base in its open, triangular form so as to extend upwardly from the corners thereof. At its other end, each of the posts has a relatively short crosspiece pivotally attached on one side for adjustment between service and storage positions, and it has a spring clip fastened to its other side short of the end.

When our bag support frame is assembled as described above, its three upstanding posts define a space designed to receive a suitably sized plastic trash bag and the bag can be opened and placed in this space, with its top pulled down over the suitably adjusted crosspieces and fastened in position by the spring clips. The bag is now ready to be filled with trash, and as the trash accumulates therein it exerts downward force on the posts, through the bag wall, as a result of which the bag itself holds the posts fairly rigid in spite of the fact that they are fastened only at their lower ends in the bag support frame. After the bag has been filled, there is enough slack in that portion folded down over the upper ends of the posts to gather together and tie with a twist fastener, or the like. The loaded bag can then be pulled easily out of the bag support frame without having to overcome a binding force such as that encountered in attempts to remove filled trash bags from garbage cans or the like. The space occupied by the bag in the support frame is not closely confined so that the bag is permitted to expand to its full holding capacity for most effective utilization thereof.

Our novel bag support frame, in its perferred form, is fabricated, for the most part, from a lightweight metal such as aluminum, and can be disassembled into parts that fit neatly and compactly into a small space for easy and convenient packing, shipping and storage purposes.

It is thus a principal object of the present invention to provide inexpensive, lightweight means for holding a plastic trash bag in upright, open position to receive trash.

It is another object of the invention to provide such means from which a filled bag is easily removable for disposal.

Another object of the invention is to provide such means permitting easy loading of the trash bag to its maximum capacity.

Yet another object of the invention is to provide such means that can be readily disassembled without tools, and fitted into a compact space for easy storage or carrying, and as readily reassembled for use when needed.

Other objects, features and advantages of the invention will become apparent to those skilled in the art in the light of subsequent disclosures herein.

BRIEF DESCRIPTION OF THE DRAWING

FIG. 1 is an isometric view of a preferred form of bag holding frame in accordance with this invention supporting a plastic trash bag in upright position for use, the outline of the trash bag being shown in phantom lines.

FIG. 2 is an isometric view of a folding base forming a part of the bag holding frame in a folded position for storage.

FIG. 3 is another isometric view of the base, this time in a partially unfolded position to illustrate how it is adjusted to a position of use.

FIG. 4 is an isometric view of the base as it appears when fully adjusted to said position of use.

FIG. 5 is an enlarged, interrupted, fragmentary view of the base in its FIG. 4 position, shown partly broken away to illustrate an important structural feature of the invention.

FIG. 6 is an enlarged side view of a tubular post with a pivotally attached crosspiece at one end forming another part of the bag holding frame, the post being shown upright and with a portion of its wall broken away to reveal hidden structural detail and the crosspiece being shown suitably positioned for storage purposes.

FIG. 7 is another side view of the tubular post, this time as seen from the right of its FIG. 6 position and showing, in phantom lines, the crosspiece pivoted to a position crosswise of the post for use in the assembled bag holding frame, a portion of a spring clip on the lower part of said post being shown partially broken away for better illustrative effect.

FIG. 8 is an enlarged bottom view of the tubular post, as seen in FIG. 7, along with a broken away part of the base to illustrate an interfitting relationship therebetween.

FIG. 9 is a still further enlarged top view of the tubular post as seen in FIG. 6.

FIG. 10 is an enlarged fragmentary side view of the tubular post and base as they appear just prior to being snapped into engagement by means of a spring clip on the post.

FIG. 11 is a view similar to FIG. 10, but showing the post and base after being snapped into such engagement.

DESCRIPTION OF PREFERRED EMBODIMENT

Considering now the drawing in greater detail, there is shown generally at 10, in FIG. 1, a preferred form of bag holding frame in accordance with this invention supporting an open plastic trash bag 12 in an upright position for use. The bag holding frame 10 is made up of a base 14 and three tubular posts 28 which are releasably interlocked in a manner soon to be described to form a frame capable of supporting the bag 12 in its illustrated position.

The base 14 is formed from three metallic strips, or sections, 16, 18 and 20 of equal length, pivotally connected at the ends in such a way that two of them (16 and 20) can swing to a folded position either side of the third, as illustrated in FIG. 2. In this folded position, the base is neat and compact and can be easily packaged or stored in minimal space. For use it is converted to a triangular shape, this being readily accomplished by swinging the sections 16 and 20 away from section 18 till their outer ends can be superimposed in the manner shown in FIG. 4. Those ends are held together in their superimposed positions by interlocking male and female means, the male means comprising a portion of the shank of a machine screw 24 tightened upwardly in a tapped hole in the end of section 20 and the female means being a mating opening 26 for the shank in the end of section 16.

The three sections of base 14 are fastened together for pivotal movement as described by means of a pair of rivets 22. They are preferably formed of a relatively lightweight metal, such as aluminum, and are thin and flexible enough so that the outer ends of sections 16 and 20 can be easily forced into their interlocked (FIG. 4) positions where, as can be seen, that of the lower section (16) is disposed above that of the upper one (20). The slight flexing of sections 16 and 20 resulting from this interlocking configuration sets up opposing forces at the outer ends of sections 16 and 20 that tend to hold them together and prevent their separation during assembly of bag holding frame 10.

As will now be clear, when base 14 is formed into the shape illustrated in FIG. 4, with the outer sections 16 and 20 interlocked in the above-described manner, it defines an equilateral triangle with an apex opposite each side. The ends of the sections 16, 18 and 20 are rounded, as shown in the drawing, and so positioned that each apex is formed from superimposed ends of two of the sections so as to be of smoothly rounded, rather than pointed or jagged, shape. There is a good reason for this, as will presently be explained.

As previously indicated, the three tubular posts 28 are designed for removable attachment to the base in its triangular configuration so as to extend upwardly from the apices thereof and provide props or braces for the folded down top of a plastic trash bag. These posts are formed from a lightweight metal, preferably aluminum, and each is provided with an identical crosspiece 30 at the top pivotally connected to one side of the latter so as to be movable between a bag support position at 90° thereto and a second position generally parallel to the axis of the post to permit close packing of the three posts for convenient shipping and storage of the parts of the disassembled bag holding frame. The crosspieces 30 are formed from rigid strips of a lightweight metal, preferably aluminum, and each is bent slightly outwardly at its ends to conform generally to the rounded wall of a plastic bag in open position so as to support the bag in such a way as to minimize tearing strain thereon as it is pulled down under the weight of trash placed therein. These bent ends can best be seen at 36 in FIG. 6, which shows one of the crosspieces 30 in side profile.

The pivotal connection of each of the crosspieces to a post 28 is such as to insure sufficient holding force on the crosspiece in any position of rotation about its pivot point to prevent rotational slippage thereof from that position. This is accomplished by utilizing a rivet 32 as the fastening means for the crosspiece and interposing a spring washer 34 between it and the post in the manner illustrated in FIG. 9, which shows such a spring washer flattened against a crosspiece to exert the necessary holding force thereon. Our invention is not limited to the use of a spring washer for this purpose, however, and any suitable alternative means, such as, for example, a spiral spring, can be used in lieu thereof if desired.

Fastened to the opposite side of each of the posts 28 from that side to which the crosspiece is attached is a spring clip (hereinafter referred to as a bag clip) 38. The bag clip 38 is formed from a strip of spring steel with a substantially straight portion 42 and a bent portion 44 shaped to serve as a yielding clamp for the upper edge of a plastic trash bag. The bag clip is fastened to the wall of the post 28 by a pair of rivets 40, with its bent portion up and spaced far enough below the top of the post to permit the open end of the trash bag to be folded outwardly over the crosspiece on the post and down to said clip for fastening in the manner soon to be described.

Near its lower end, each of the posts 28 has a transverse slot 46 extending inwardly from the side to which a crosspiece 30 is attached. This slot extends somewhat more than halfway through the post and is of the proper width, or vertical dimension as seen in FIG. 6, to snugly receive a corner of the base 14 in the manner best illustrated in FIG. 11, where such a corner can be seen at 54 in interfitting relationship with a slot 46.

Below the slot 46, a portion of the cylindrical wall of each tubular post 28 is bent inwardly toward the opposite half of the tube wall to the position illustrated at 56 in FIG. 8 to provide space for easy accessibility to the slot by a corner 54 of the base 14 during assembly of the bag holding frame. Also, the post has a base clip 48 attached thereto at the bottom. This clip, similarly to bag clip 38, is formed from a strip of spring steel and has a relatively straight segment 50 and a bent, or curved, segment 52. The bent segment 52 has an upper loop portion 58 adapted to fit between the two sections forming a corner of base 14 in its triangular configuration and hold their rounded ends snugly in position in the slot 46 on the post. Below this upper loop portion 58, the base clip reverses its bend direction to form a lower loop portion with a cam-like bottom 60. The base clip is fastened to post 28 by means of two rivets 40 through its straight segment 50. When the post is detached from the base 14, the base clip 48 assumes a position in which its straight segment 50 lies closely adjacent the post wall, as shown in FIG. 6, and the cam-like bottom 60 of its lower loop portion extends slightly into the space created by the inward bend of the post wall below slot 46, again as shown in FIG. 6.

To attach a post 28 to the base 14, the post can be brought to the position shown in FIG. 10 relative to corner 54 of the base, whereat the cam-like bottom 60 of the lower loop portion of the base clip rides on top of the uppermost of the two sections of the base forming that corner. From this position, the post can be easily rotated clockwise, as seen in FIG. 10, until the base clip snaps into the space between the two sections and locks the post and base member together in the manner illustrated in FIG. 11. The rounded corner 54 of the base now nests in the hollow created by slot 46, and its bottom rests on an arcuate shoulder 62 formed in part by the post wall defining the bottom of slot 46 and in part by the inverted portion 56 of that wall. Disassembly of the post and base can be easily accomplished by manually rotating the post in the counterclockwise direction until the base clip rides up from between the two sections forming the corner 54 to the position shown in FIG. 10 and then separating the post from the base.

As will now be clear, the bag holding frame 10 can be quickly and easily assembled from its component parts by snapping the tubular posts 28 into position at the corners of the base 14 in the above-described manner. It will be evident from the drawing, and particularly FIG. 1, that the lower ends of posts 28 serve as feet to support the overall assembly, and the crosspieces at the upper ends of the posts face inwardly toward the space surrounded thereby. The triangular configuration of the base 14 prevents relative movement of its pivoted sections where they are joined at its corners and thereby insures structural integrity of the frame assembly.

When the crosspieces 30 are turned perpendicularly to the posts 28, as shown in FIG. 1, the bag holding frame is ready to receive a plastic trash bag. Such a bag can then be opened and fitted into the space enclosed by the posts 28, and its top folded down over the posts and fastened in position by means of the bag clips 38 in the manner illustrated in FIG. 1, where, as previously indicated, the outline of such a bag is there shown in phantom lines at 12. The result is a neat, lightweight trash holder occupying a relatively small space and of more esthetically acceptable appearance than a conventional garbage can. As the bag fills with trash, its folded top pulls downwardly and on the posts and thereby serves to hold them firmly in place. The bag clips 38 prevent the top of the bag from being pulled away from the posts and permit the bag to be filled to capacity without difficulty. After the bag is properly filled, it is a simple matter to release its top from the clips 38 and bunch it together for tying, then lift it out of the surrounding frame for easy disposal.

While the novel bag holding frame of this invention has been herein illustrated and described in what we presently consider to be a preferred embodiment, it will be appreciated that various modifications thereof are possible within the scope of the invention. Some of these modifications have already been mentioned, and others will occur to those skilled in the art in the light of present teachings. Although the bag holding frame has been illustrated solely herein in its capacity as a trash bag holder, it should be understood that its utility is not so limited and that it can be employed for any purpose within its structural and functional capability. Finally, it goes without saying that the scope of the present invention extends to all variant forms thereof encompassed by the language of the following claims.

We claim:

1. Bag holding means particularly adapted to hold a plastic trash bag in an upright position to receive trash comprising base means and post means designed for interlocking engagement to form a frame adapted to receive the open bag;

said base means in said frame having three structural mating means spaced therearound;

said post means comprising three posts, each having a mating counterpart for a separate one of said mating means the resulting counterparts being adapted to mate with said mating means so that the base means is held in generally horizontal position near the bottom of the upright frame, said posts having releasable securing means attached for holding the mating means and counterparts in mating relationship;

said frame serving to receive an empty bag of suitable size right side up in the space circumscribed by said posts and permit the top of the bag to be folded outwardly and downwardly over the tops of said posts, whereby the bag can be loaded, then easily pulled upwardly out of said space for proper disposition thereof; and said base means comprising three strips of suitably rigid material, two of which strips are each pivoted at one end to a separate end of the third and are provided with releasable interlocking means at their opposite ends whereby the three strips can be formed into a triangular configuration with said opposite ends releasably interlocked and the corners of said triangular configuration form said mating means;

wherein said posts are formed from segments of tubing and each post has a transversely extending slot sized to receive a corner of said triangular configuration and thereby serve as a seat for that corner comprising one of said counterparts.

2. Bag holding means in accordance with claim 1 wherein each post has a crosspiece attached near its end farthest removed from said transversely extending slot therein, said crosspiece serving to prop up a peripheral portion of the folded down top of a plastic bag placed in said frame.

3. Bag holding means in accordance with claim 2 in which the slot in each post extends more than halfway through the width of said post and the wall of said post below the slot is inverted, whereby space is provided for the tilting of said post relative to the base means when a corner of the latter is being inserted in said slot.

4. Bag holding means in accordance with claim 3 in which said releasable securing means comprises a spring clip attached to each post and having a curving segment with a free end, which segment is adapted to fit between the strips forming an adjacent corner of said base means and exert spring pressure on said strips to hold said corner in said slot in said post in the assembled frame.

5. Bag holding means in accordance with claim 4 in which said curving segment of said spring clip has a compound bend forming one loop that fits between said strips to hold said corner in said slot and a second loop with a cam-like bottom that rides on top of said base means as a corner of the latter is fitted into said slot and then snaps down between the strips forming said corner to releasably hold the base means and post together.

6. Bag holding means in accordance with claim 5 in which the strips forming said base means fold together for storage when not in use, and said interlocking means at the opposite ends of two of the strips comprise male and female means so positioned that these strips must be bent slightly for interlocking engagement of their ends whereby pressure is exerted therebetween tending to hold said ends in engagement.

7. Bag holding means in accordance with claim 6 in which said crosspieces are flat strips bent slightly at each end to conform generally to the rounded shape of the folded down top of a bag positioned in said frame; and in which said crosspieces are pivotally fastened to said posts for rotational movement between positions transverse of the posts for propping up said bag in said frame and straight positions, relative to said posts, for compact storage of the disassembled posts.

8. Bag holding means in accordance with claim 7 in which:

the strips of said base means are of substantially equal length and of aluminum construction;

said posts are of substantially equal length and formed from aluminum tubing;

the ends of said strips are rounded for good interfit between said corners and said slots; and said posts are provided with spring clips properly positioned to receive and hold the folded down top edge of a bag positioned in said frame to prevent slippage of the top of the bag out of place as it is being filled.

* * * * *